United States Patent [19]

Claypool

[11] 4,213,261

[45] Jul. 22, 1980

[54] BREECH LOCKING MECHANISM

[75] Inventor: James P. Claypool, 2124 Como Ave., St. Paul, Minn. 55108

[73] Assignees: James P. Claypool; James E. Trombley, both of St. Paul, Minn.

[21] Appl. No.: 919,501

[22] Filed: Jun. 27, 1978

[51] Int. Cl.[2] ..... F41C 11/06

[52] U.S. Cl. ..... 42/16; 89/187 CB

[58] Field of Search ..... 42/16, 17, 18; 89/187 CB, 187 R, 186, 180, 190, 173, 176

[56] References Cited

U.S. PATENT DOCUMENTS

| | | | |
|---|---|---|---|
| 726,187 | 4/1903 | Von Augezd | 42/16 |
| 870,719 | 11/1907 | Freeman | 42/16 |
| 1,340,891 | 5/1920 | Graham | 89/187 R |
| 1,340,943 | 5/1920 | Eickhoff et al. | 89/187 R |
| 1,587,049 | 6/1926 | Swebilius | 42/17 |
| 2,089,671 | 8/1937 | Stecke | 89/187 R |
| 2,651,974 | 9/1953 | Simpson | 89/187 CBB |
| 2,890,626 | 6/1959 | Amsler | 89/187 CBB |
| 2,953,066 | 9/1960 | Colby | 89/186 |
| 3,213,558 | 10/1965 | Horsrud | 42/17 |
| 3,473,434 | 10/1969 | Brieger | 89/181 |
| 3,566,745 | 3/1971 | Jauch et al. | 89/187 CBB |
| 3,848,510 | 11/1974 | Wolpert | 89/187 CBB |
| 3,866,344 | 2/1975 | Kawamura | 42/16 |

*Primary Examiner*—Charles T. Jordan

*Attorney, Agent, or Firm*—Orrin M. Haugen; Thomas J. Nikolai

[57] ABSTRACT

A firearm breech locking mechanism which includes a receiver having a longitudinal track guiding an actuating rod in reciprocating motion, and two guide slots for guiding a bolt carrier member mechanically coupled to the operating rod. Two roller receiving slots are also formed in the receiver member. A roller is disposed in these slots. It extends transversely to the direction of motion of the operating rod. A cam surface on the operating rod raises the roller as the operating rod reaches its forwardmost position to thereby lock the bolt relative to the receiver and shell chamber. As the operating rod is moved rearward, a cam surface on the bolt carrier forces the roller to its unlocked position. The invention further includes a latch pivotally secured to the bolt member which cooperates with a recess formed along one of the guide slots. This latch maintains the operating rod and bolt carrier separated from the bolt by a predetermined distance and ensures that the bolt carrier does not fully engage the bolt before the cam surface on the operating rod elevates the roller into its groove in the bolt.

In an alternative embodiment, the locking roller elevating cams are disposed on the receiver member rather than on the operating rod. By reconfiguring the bolt to include an integrally formed slotted lug through which the locking roller may pass, certain simplification results.

7 Claims, 10 Drawing Figures

BREECH LOCKING MECHANISM

BACKGROUND OF THE INVENTION

I. Field of the Invention

This invention relates generally to automatic or semi-automatic firearms and more particularly to a breech block locking mechanism for maintaining the bolt in rigid locked relationship with respect to the shell chamber during firing and for subsequently releasing the bolt for rearward motion during extraction and ejection of the spent cartridge.

II. Description of the Prior Art

Various arrangements are knwon in the art for withdrawing a cartridge from a magazine, urging the cartridge into the chamber and for locking the bolt behind the chamber during firing and for subsequently automatically unlocking and moving the bolt in a rearward direction to extract the spent cartridge casing from the chamber and eject it from the firearm. For example, in the Amsler U.S. Pat. No. 2,890,626 there is described a firearm having a bolt which is slidably movable in a breech body and which includes a locking arrangement having two cylindrical rods cooperating with curved faces formed in two locking grooves. While the pins function to lock the bolt relative to the breech block during the firing segment of the operating cycle, the device of the Amsler Patent must rely upon a number of springs and pawls for accomplishing the locking function. As such, the firing mechanism is subject to undue wear and necessary maintenance and replacement.

The Stecke U.S. Pat. No. 2,089,671 describes a breech block locking arrangement in which two symmetrical locking levers are carried by the breech block and mounted therein so as to be rotatable and slidable relative to the breech block. These locking levers have outer arms which cooperate with inclined walls such that during a short initial rearward movement of the breech block, the locking levers are turned by the inclined walls to impart a relatively slow initial movement rearward, followed by a more rapid translation of the breech block or bolt member following this initial period.

The present invention relates indirectly to each of the aforementioned prior art patents but is deemed to be a substantial improvement over the devices described therein. The improvement over the Amsler Patent resides principally in the fact that the present invention is constructed with substantially fewer moving parts and is therefore less costly to manufacture and more easily maintained. As will be more particularly pointed out when the details of the construction of the preferred embodiment are set out herein, the present invention does not require the use of springs, pawls, and various other small parts which are subject to wear and deterioration during use.

The present invention is also a significant advance over the invention described in the Stecke Patent, supra, in that manner in which the various moving parts are fabricated such that the full force of the exploding gases reacting on the bolt are resisted by a rigid pin in such a fashion that repeated use over prolonged periods does not deleteriously effect the functioning of the firearm.

Another advantage of this invention over the two above lies in a single roller concept in cooperation with a cam configuration which provides positive locking plus slow initial extraction, or withdrawal, of the fired cartridge case. The use of a single roller of an increased radius provides greater shear strength, in that shear strength is proportional to the square of the radius.

SUMMARY OF THE INVENTION

In accordance with the teachings of the present invention, in a first arrangement, there is provided a breech block locking mechanism for a firearm which includes only five major moving parts:

(1) a receiver member;
(2) an operating rod;
(3) a bolt carrier;
(4) a bolt; and
(5) a locking pin (roller).

The receiver member has a first longitudinally extending guide track formed in a bottom surface thereof for receiving the operating rod and guiding same for reciprocating motion therein. The receiver member also includes a pair of longitudinally extending guide slots formed in parallel and spaced apart side surfaces of the receiver member. These guide slots accommodate first and second parallel and spaced apart fingers formed on the bolt carrier. The bolt carrier is mechanically coupled to the operating rod such that it is carried along therewith. The bolt, itself, is mounted between the parallel fingers of the bolt carrier and has a portion thereof extending into the above-mentioned guide slots in the receiver so that it, too, reciprocates with the operating rod during the operating cycle of the firing mechanism.

There is also formed in the parallel side surfaces of the receiver member locking pin receiving slots which are oriented at a predetermined angle with respect to the longitudinal direction of the guide track and the guide slots. A cylindrical locking pin or roller passes through these locking pin receiving slots and is oriented transversely to the longitudinally extending guide track. The arrangement is designed such that a cam surface or ramp formed on the actuating rod coacts with the roller or locking pin to elevate same within the locking pin receiving slots as the bolt and bolt carrier move forward into a blocking relationship with respect to the firearm's chamber. When in its fully elevated position, it abuts a portion of the bolt and locks the bolt firmly with respect to the receiver member.

The mechanism in accordance with a first embodiment of the present invention further includes a lever or finger which is pivotally secured along one side of the bolt so as to reside at least partially within one of the aforementioned guide slots. There is also formed in this particular guide slot a notch or recess. As the bolt is thrown home, a cam surface or ramp on the bolt carrier coacts with the lever or finger to pivot same so that it engages the notch formed in the guide slot. The cooperation of the latch with the recess ensures that the bolt carrier does not overlap the bolt until the bolt is firmly locked in place in a closing relationship with respect to the chamber prior to firing.

As the operating rod is forced rearward following firing by the escaping gases, for a short distance, the bolt is cammed slowly rearward by the action of the bolt carrier cams on the roller. However, a point is reached during the rearward travel of the operating rod where the bolt is again engaged by the operating rod and it moves in unison therewith at a relatively higher rate. The initial slow rearward movement of the bolt facilitates the extraction of the spent cartridge from the chamber and prevents breakage of the extractor as well as the possibility for torn shell case rims.

In accordance with a second embodiment of the invention, the design is somewhat simplified in that the need for a separate bolt carrier member is eliminated and, furthermore, the configuration of the receiver member is somewhat simplified in that the guide slots are also eliminated. This is accomplished, in part, by providing the locking roller elevating cams on the receiver member rather than on the operating rod or slide. Also, the bolt is somewhat re-configured to provide an integrally formed lug having a locking pin receiving slot formed therethrough, the arrangement being such that when the slide and bolt move relative to the receiver member, the cam surfaces on the receiver engage the locking pin causing it to be lifted into a locking relationship with respect to the receiver. Rather than having the angulated slot formed in the receiver member, in accordance with the second embodiment, the slot is somewhat re-configured and formed in the operating rod. The cooperating relationship between the locking pin in the angulated slot in the operating rod and the cam surface formed on the receiver causes an initial slow withdrawal of the bolt from its locked position subsequent to firing, followed by a later more rapid withdrawal. As such, wear and tear in the extractor fingers and the propensity for torn shell casing rims is obviated.

OBJECTS

It is accordingly the principal object of the present invention to provide a new and improved operating mechanism for a firearm.

Another object of the invention is to provide an improved breech block locking mechanism involving a minimum of separate moving parts.

Yet another object of the invention is to provide a new and improved breech block locking mechanism designed to withstand the substantial forces impressed upon the bolt during the firing cycle.

Still another object of the invention is to provide a new and improved breech block locking mechanism which allows extraction of a spent cartridge at a relatively slow rate for a predetermined portion of the ejection cycle.

A yet still further object of the invention is to provide a breech block locking mechanism for a firearm which is simple in construction, easy to maintain, inexpensive to manufacture and reliable in operation.

These and other objects and advantages of the invention will become apparent to those skilled in the art from the following detailed description of the preferred embodiment when considered in conjunction with the accompanying drawings.

DESCRIPTION OF THE PREFERRED EMBODIMENT

Figure 1:
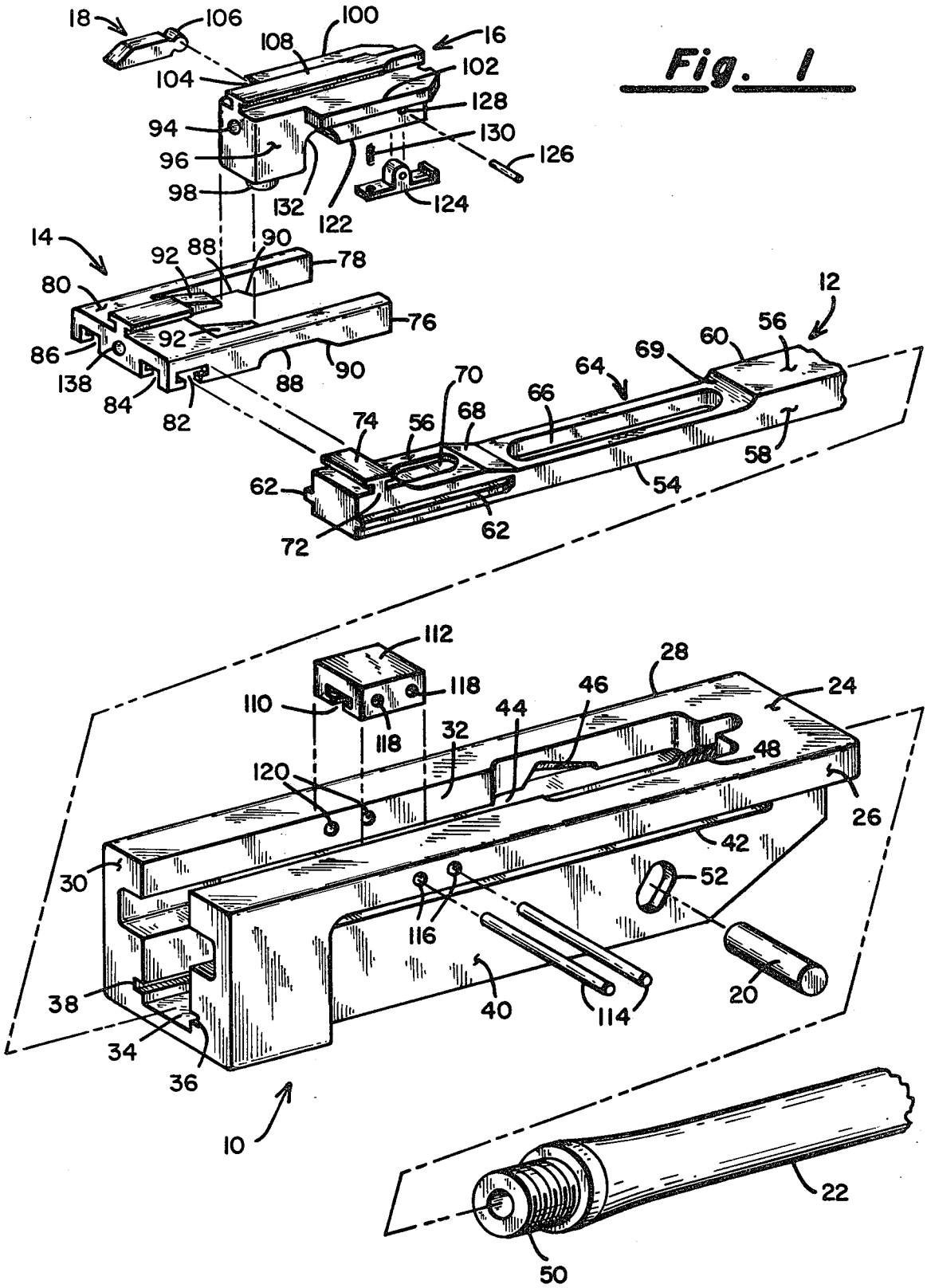
FIG. 1 is an exploded view showing the various operating parts comprising the preferred embodiment and their relationship, one to the other.

Referring first to FIG. 1, there is shown a receiver member indicated generally by numeral 10, an operating rod 12, a bolt carrier 14, a bolt 16, a bolt latch 18 and a locking roller or pin 20. Also illustrated for purposes of orientation is a gun barrel 22 which is adapted to be threadedly engaged in a threaded bore formed in the front end of the receiver member 10.

As can be seen from FIG. 1, the receiver member 10 comprises a block of suitable steel which is generally rectangular but which is milled out or cast to provide a number of grooves, surfaces and slots which will be described more particularly hereinbelow.

Specifically, the receiver member 10 has a top surface 24, a right side surface 26, a left side surface 28 and a rear surface 30. A generally rectangular channel 32 is formed midway between the right and left side surfaces 26 and 28 and extends downward into the receiver block and terminates at a bottom surface 34. Formed in the internal side walls of the channel 32 are first and second longitudinally extending grooves 36 and 38 which, along with the bottom surface 34, define a first longitudinally extending guide track.

The side surfaces 26 and 28 are each milled inwardly to define an integrally formed side plate as 40 on side surface 26. Slots 42 and 44 are cut through the side plates 40 and extend in a parallel and spaced apart relationship longitudinally along the length of the receiver member 10. For reasons which will become more apparent as the description continues, the slots 42 and 44 are referred to as "guide slots". One of the guide slots 44 includes a generally triangular shaped recess 46 which extends upwardly from the guide slot towards the top surface 24 of the receiver member 10.

A threaded bore 48 is formed through the front end surface of the receiver member 10 and communicates with the channel 32. The threaded portion 50 of the barrel 22 is adapted to be screwed into the bore 48 formed in the receiver member. The bore 48 is generally aligned with the first and second guide slots 42 and 44.

Formed through each of the side plates 40 is a generally oval locking pin receiving slot 52 whose major access is inclined at a predetermined angle with respect to the direction of the guide slots 42 and 44. The locking pin or roller 20 is adapted to be inserted through these locking pin receiving slots such that it is oriented transversely to the longitudinal access of the channel 32. The length of the locking pin or roller 20 is such that its opposed ends extend a predetermined distance outward from each side plate 40 when the pin 20 is inserted through the locking pin receiving slot 52.

Still with reference to FIG. 1, it can be seen that the operating rod 12 comprises a generally rectangular bar of steel having a generally flat bottom surface 54, a top surface 56 and opposed parallel side surfaces 58 and 60. Extending outwardly from either side surface 58 and 60 is a rib 62 which is dimensioned and oriented so as to slide within the guide slots 36 and 38 formed in the receiver member 10. When the ribs 62 are disposed in the guide slots 36 and 38, the bottom surface 54 of the operating rod abuts the bottom surface 34 of the receiver member 10. Thus, the operating rod may slide back and forth in a reciprocating fashion within the receiver 10.

Formed in the upper surface of the operating rod 12 is a milled out portion indicated generally by numeral 64 which includes an elongated slot 66 passing completely through the operating rod from top to bottom and which is generally coaxial with the longitudinal axis of the operating rod itself. The recess 64 also includes at the rear portion thereof an upwardly inclined cam surface or ramp 68. At the front end of the recess 64 is an arcuate upwardly extending curved surface 69.

To the rear of the inclined ramp 68 is an oval slot 70 which is milled inwardly from the top surface 56 of the operating rod.

Located at the rear of the operating rod is an upwardly extending pedestal portion 72 having an integrally formed T-shaped projection 74.

The bolt carrier 14 comprises a generally U-shaped member having first and second parallel and spaced apart fingers 76 and 78 integrally formed with a cross member 80. Extending transversely across the cross member 80 and formed in the bottom surface thereof is a T-shaped slot through which the T-shaped projection 74 of the operating rod may pass. Thus, the bolt carrier may be rigidly coupled to the operating rod by inserting the T-shaped projection 74 of the operating rod 12 into the T-shaped groove 82 of the bolt carrier. Also formed in the bottom surface of the bolt carrier 14 are first and second longitudinally extending grooves 84 and 86 which extend completely along the underside of the cross member 80.

Formed on the undersurface of each of the fingers 76 and 78 is a recess 88 which includes an inclined ramp portion 90, the purpose of which will be set forth with more particularity hereinbelow. Integrally formed with and extending outwardly from the inside edge surfaces of the fingers 76 and 78 are ramps 92.

When the bolt carrier 14 is assembled onto the operating rod 12 in the manner already described and when the operating rod 12 is inserted into the receiver 10 so that the ribs 62 fit into the guide tracks 36 and 38, the bottom surfaces of the ramps 92 ride along the exposed upper edge of the side plates 40 which define the guide slots 42 and 44. Also, when in this configuration, the fingers 76 and 78 of the bolt carrier abut the outside side surfaces of the right and left side plates 40 of the receiver member 10. That is, the upper edge surfaces defined by the side plates 40 and the guide slots 42 and 44 fit within the grooves 84 and 86 formed through the cross member 80 of the bolt carrier 14.

The details of the construction of the bolt member 16 will next be described. As is illustrated in FIG. 1, the bolt member comprises a block of cold rolled steel through which is formed a longitudinally extending bore 94 which is adapted to receive an elongated firing pin (not shown). The rear portion of the bolt member 16, identified by numeral 96, is dimensioned so as to fit between the vertical side surfaces of the ramps 92 formed in the bolt carrier. Extending downwardly from the bottom surface of the rear portion 96 is a generally cylindrical projection 98 having an outside diameter slightly less than the width of the slot 70 formed in the upper surface 56 of the operating rod 12. Thus, when the bolt member 16 is positioned between the vertical edges of the ramps 92, the cylindrical projection 98 fits within the slot 70 and is relatively movable therein in a longitudinal direction to the extent permitted by the axial length of the slot 70. Extending outwardly from either side of the block 96 are generally horizontal flanges 100 and 102. The overall width of the bolt member 16 as defined by the vertical edges of the flanges 100 and 102 is such that the bolt member 16 will fit between the fingers 76 and 78 of the bolt carrier. As such, when the bolt is positioned between the fingers of the bolt carrier and the bolt carrier is assembled to the operating rod and the operating rod is inserted within the receiver, the bolt member 16 is free to slide along with the operating rod back and forth within the receiver member in a reciprocating fashion.

There is also formed at the rear edge of the flange 100 a generally circular notch or opening 104 into which may be fitted the generally cylindrical portion 106 of the locking latch 18. The circular notch 104 is such that the latch 118 can only be inserted from the side and once in position cannot be removed except by withdrawing it from the same entry side. Because of the shape of the latch 18, it can be seen that it is free to pivot, within limits, between a generally aligned position with the flange 100 and a position which is inclined with respect to the flange by a predetermined angle.

Formed on the top surface of the bolt member 16 is a T-shaped feed rib 108. This T-shaped projection is adapted to slide within the T-shaped groove 110 formed in the ejector block 112 which is adapted to be secured into the channel 32 of the receiver 10 by means of the pins 114 which may be inserted through the apertures 116 in the right side surface of the receiver, the apertures 118 formed through ejector 112 and into the apertures 120 formed in the left side surface of the receiver 10.

While not shown in FIG. 1, there is formed on the undersurface 122 of the bolt 16 a median slot extending longitudinally and communicating with the front edge surface thereof. A conventional spring loaded extractor 124 fits within this recess and is held in place by a pin 126 which is adapted to pass through the aperture 128 formed in the bolt. The spring 130, because of its location with respect to the pin pivot connection 126, causes the extractor to engage the lip on the rear of the cartridge (not shown) and as the bolt is withdrawn, the cartridge casing will be drawn with it because of the engagement by the extractor member.

Now that the details of the construction of the several piece parts have been set forth, consideration will next be given to the mode of operation.

OPERATION

As used throughout this specification, the term "forward" shall mean the direction or location proximate the barrel end of the receiver and the term "rearward" shall mean the direction or location proximate the end 30 of the receiver member 10.

While not shown in any of the views, the firearm employing the present invention includes a generally horizontal compression spring which coacts with the rearward end of the operating rod 12 to normally urge the operating rod and the several parts coupled thereto in a forward direction. Rearward motion of the operating rod and its associated parts is accomplished by means of a piston (not shown) which operates under the force of the expanding gases obtained upon firing of a cartridge.

Figure 2:
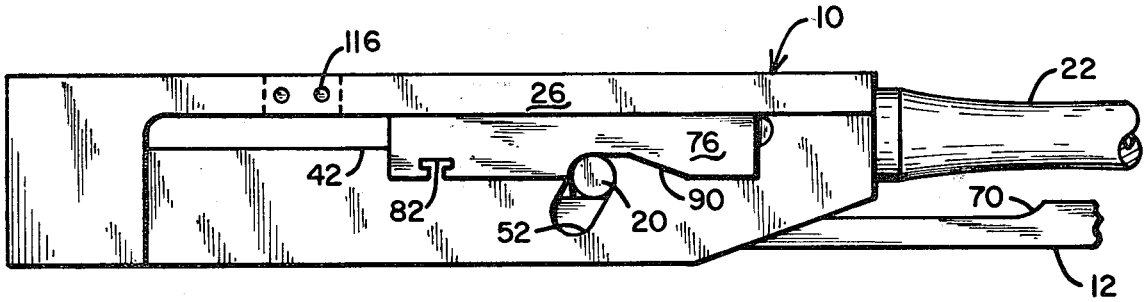
FIG. 2 is a right side elevation with the bolt in its locking or firing position.
Figure 3:
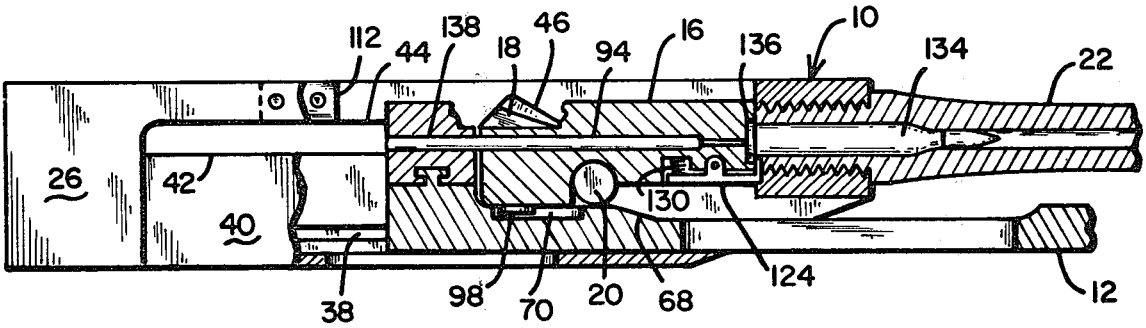
FIG. 3 is a right side sectional view showing the orientation of the various parts when in the locked or firing position.

With reference to FIGS. 2 and 3, there is shown a right side elevation and a partially cross-sectioned right side elevation of the operating mechanism when the bolt is in its fully locked relationship with respect to the receiver member such that the gun is ready for firing. As can best be seen from the view of FIG. 3, when the operating rod 12 is in its forward position, the ramp 68 formed on the operating rod has lifted or elevated the locking pin 20 within the locking pin receiving slots 52 formed in the right and left side plates 40 of the receiver member. When in this position, the locking pin 20 is partially contained within the transversely extending semi-circular opening 132 formed on the underside of the bolt member 16. Because the length of the locking pin 20 is such that its opposed ends abut the edge surfaces of the slots 52 formed in the side plates of the receiver, the bolt 16 is prevented from moving rearward until such time as the operating rod 12 moves rearward. Thus, the shell 134 is positively held in the chamber and the breech is closed and locked. Also, as can be seen from FIG. 2, the extractor 124 under the action of the spring 130 grips the rim 136 of the cartridge so that when the bolt ultimately is moved to the rear, the casing of the cartridge 134 will be also drawn to the rear, allowing ejection thereof through a slot (not shown) formed in the bottom surface of the receiver member 10.

It also may be seen that the longitudinally extending bore 94 formed through the bolt 16 is aligned with a corresponding bore 138 formed through the cross member 80 of the bolt carrier 14. Thus, a path is established through which the firing pin may pass to abut the primer of the cartridge 134.

It also may be seen from FIG. 3 that when the bolt is in its fully locked position, with the operating rod fully forward, the ramps 92 (FIG. 1) on the bolt carrier engage the detent finger 18 causing it to pivot upwardly in a clockwise direction so that the rear edge surface thereof abuts the corresponding edge of the recess 46 formed in the guide slot 44. In this orientation, the bolt carrier 14 is able to move forward with respect to the now stationary bolt so that its forward edge surface abuts the rear of the bolt so that the firing pin can reach the primer of the shell or bullet.

Figure 4:
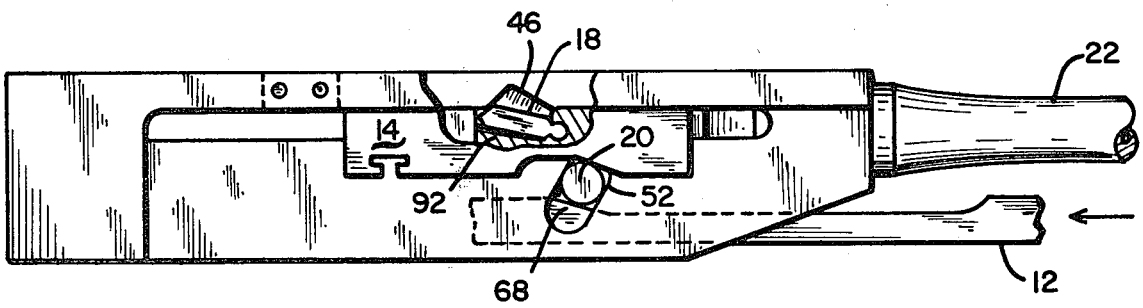
FIG. 4 is a right side elevation with the bolt partially unlocked from the receiver member.

Referring next to FIG. 4, it is assumed that the trigger has been pulled and the shell has been fired. The escaping gas in the barrel is routed through a piston (not shown) so as to initiate the rearward movement of the operating rod 12 against the force of the recoil spring (not shown) which coacts with the rear end surface of the operating rod. As the ramp 68 of the operating rod passes beneath the locking pin or roller 20 during its rearward motion, the locking pin 20 begins to descend in its oval slot 52. However, the bolt is still firmly latched in its closed position because the detect finger 18 remains elevated by the ramp 92 on the bolt carrier 14 so as to engage the rear edge of the recess 46. It is to be further noted from the view of FIG. 4 that as the bolt carrier moves rearward, the ramps 90 formed on the fingers 76 and 78 engage the cylindrical side surfaces of the locking pin or roller 20 to force the locking roller in a downward and rearward direction against the ramp 68 of the operating rod 12. Thus, the locking pin 20 does not rely upon gravity for its downward travel, but instead, the roller, in being cammed downwardly and rearwardly exerts a strong slow initial movement of the bolt.

Figure 5:
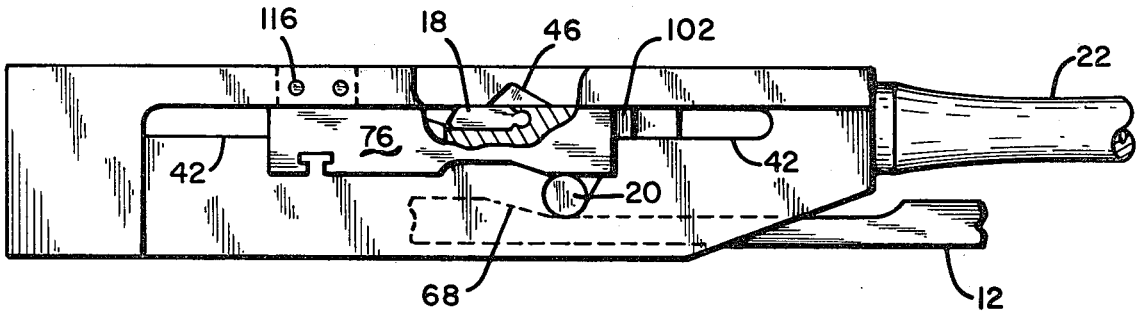
FIG. 5 is a right side elevation with the bolt in a fully unlocked position with respect to the receiver member.

With reference to FIG. 5, this view shows the condition of the parts as the operating rod 12 continues in its rearward direction following the firing of a cartridge. Here, the operating rod 12 has moved rearward a sufficient distance such that the ramp 68 is clear of the locking pin 20 and the bottom edge surface of the fingers 76 and 78 of the bolt carrier have forced the locking pin to the bottom of its slot 52. By the time that the operating rod has traveled this distance, the front edge of the slot 70 formed in the operating rod now engages the cylindrical projection 98 formed on the underside of the bolt 16 such that the bolt now begins its rearward travel at the same rate or speed at which the operating rod moves rearward. Further, the bolt carrier has moved rearward relative to the bolt itself a sufficient distance such that the ramps 92 formed on the bolt carrier no longer coact with the detent finger 18 of the bolt. As such, the detent finger lies in its generally horizontal orientation and is free to pass through the guide slot 44 formed in the left side plate of the receiver member 10.

Prior to the time that the operating rod 12 has moved to a position at which the cylindrical projection 98 on the bolt engages the front edge of the slot 70, the bolt 14 began its rearward travel at a speed which is substantially less than the rate at which the operating rod itself is moving. This is due to the fact that the locking pin receiving slots 52 are oriented at an angle with respect to the longitudinal direction of travel. Therefore, the bolt can only move at the rate determined by the descent of the ramp 68 formed on the operating rod. This is an important feature and improvement of the present invention in that the initial extraction of the spent shell casing from the chamber occurs at a substantially lower rate than would be the case if the bolt and operating rod moved completely in unison from the outset. This initial slower rate of retraction saves wear and tear on the extractor mechanism 124 and also eliminates the propensity of the mechanism to jam should the shell gripping fingers of the extractor become unduly worn or the rims of the shell casing tear through.

Figure 6:
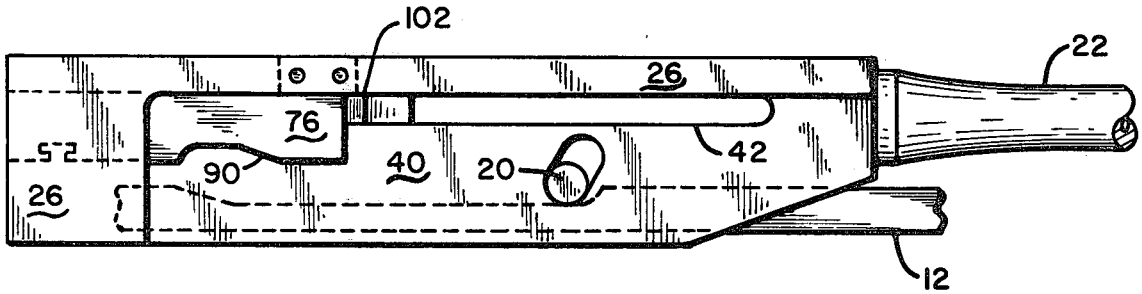
FIG. 6 is a right side elevation showing the bolt and operating rod in their rearmost orientation.

FIG. 6 illustrates the orientation of the various parts when the operating rod 12 is at its rearmost position prior to the time that it is again urged forward by the action of the recoil spring (not shown). As is shown in FIG. 6, the locking pin 20 now engages the arcuate ramp surface 69 formed on the forward portion of the recess 64 of the operating rod 12, preventing any further rearward motion of the operating rod. To reduce the impact force between the arcuate ramp on the operating rod and the locking roller, a suitable buffer (not shown) may be utilized. Once the rearward momentum of the moving parts is arrested by the coaction of the locking pin 20 with the front edge 69 of the recess 64, the compression-type recoil spring again takes over to force the operating rod forward to drive a new shell from a magazine (not shown) and carry it into the gun's chamber. During the initial portion of this forward motion of the operating rod, bolt carrier and bolt, the bolt remains separated from the bolt carrier by a predetermined spacing in that the detent finger 18 coupled to the bolt abuts the forward edge of the ramp 92. The width of the guide slot 44 is such that the ramp 92 cannot pass beneath the detent finger 18 until such time as the detent finger 18 passes under the recess 46 formed in the upper edge surface of the guide slot 44. At this time, the locking phase again begins to take place with the bolt carrier slamming home against the rear surface of the bolt 16 and its ramp 92 forcing the detent finger 18 upwards into the recess 46.

At this same point, the inclined ramp 68 at the rear end of the recess 64 of the operating rod 12 again engages the locking pin 20 forcing it upwards in its locking pin receiving slot 52 which is the position of the parts illustrated in FIGS. 2 and 3. Thus, a cycle of operation has been completed and firing can again take place.

DESCRIPTION OF ALTERNATIVE EMBODIMENT

Figure 7:
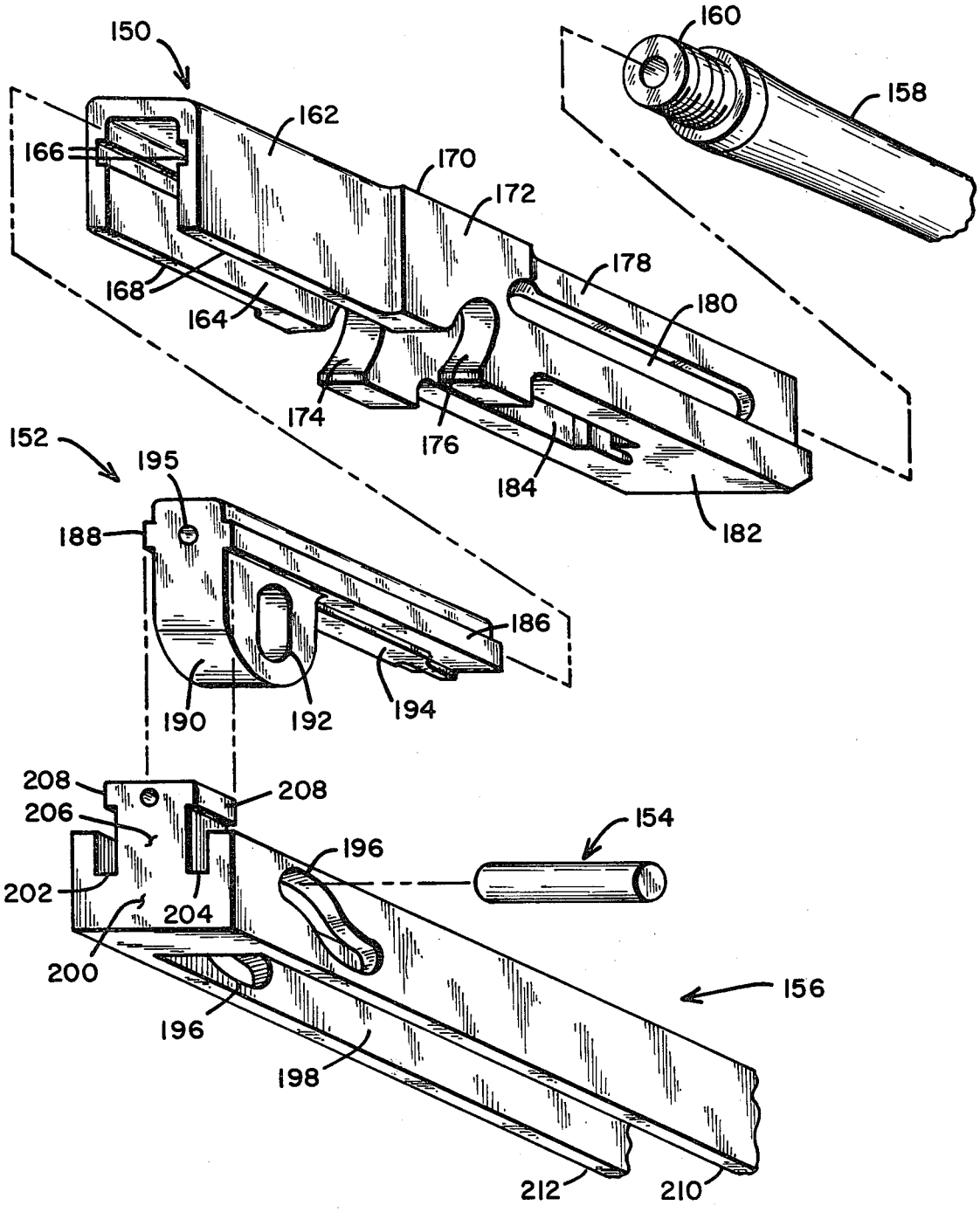
FIG. 7 is an exploded perspective view of the breech locking mechanism in accordance with an alternative embodiment of the invention.

Referring now to FIG. 7, there is shown by means of an exploded perspective view a breech block locking mechanism for a firearm constructed in accordance with a second embodiment of the present invention. Identified by numeral 150 is the receiver member and the bolt, locking roller and operating rod or slide are respectively identified by numerals 152, 154 and 156. A portion of the barrel 158 is also illustrated and it includes an externally threaded portion 160 which is adapted to be screwed into an internally threaded bore (not shown) formed in the forward end of the receiver member 150.

The receiver member 150 is preferably formed from case hardened steel and includes a rearwardly extending portion 162 having a U-shaped channel 164 extending therethrough and having outwardly extending recesses 166 formed on the internal side walls of the channel. The bottom edge surfaces 168 of the rearwardly extending channel portion 162 are coplanar and extend parallel to the guide channels 166.

The rearward portion 162 joins a midsection portion 170 whose side surfaces 172 project outwardly from the side surfaces of the rearwardly extending portion 162. Formed in the walls of these side surfaces 172 are arcuate locking roller camming surfaces 174 and 176. Specifically, arcuate notches are formed in the side surfaces and extend inwardly to communicate with the channel 164. Also formed on either side surface of the receiver member 150 and forward of the midsection portion 170 are inwardly extending recesses as at 178. A longitudinally extending slot 180 is formed through the recessed portion 178 so as to provide an exit for a spent shell casing during the ejection phase of operation. Furthermore, there is formed in the bottom surface 182 of the forwardly extending portion of the receiver member 150 a generally transverse slot 184 which is adapted to receive a clip of cartridges (not shown).

The bolt identified generally by numeral 152 is also formed from case hardened steel or other suitable material and includes integrally formed, outwardly extending flanges 186 and 188 extending longitudinally along opposed side surfaces thereof. As will become more apparent when the other views are described, the flanges 186 and 188 are adapted to fit within the guide slots 166 formed in the receiver member 150 to allow longitudinal reciprocating travel of the bolt member 152 within the receiver. A downwardly extending lug 190 is integrally formed with the bolt member at the rearward end thereof and a transversely extending aperture 192 is formed through the thickness of the lug which includes semicircular ends separated by generally straight wall segments. A longitudinally extending rib 194 is formed along the bottom surface of the bolt 152 approximately midway across the width of the bolt. Finally, a longitudinally extending bore 195 is centrally disposed in the bolt and extends completely through the length dimension thereof. The bore 195 is adapted to accommodate the firing pin (not shown).

The locking pin or roller 154 is merely a cylindrical rod having a diameter such that it may pass through the slot 192 formed through the lug 190 of the bolt and of a length such that it will extend outwardly from either side of the lug 190 so that its peripheral surface may engage the edge walls of an arcuate slot 196 formed through the side walls of the operating rod or slide 156.

Still with reference to the exploded view of FIG. 7, it can be seen that the operating rod or slide 156 comprises a generally rectangular bar which is formed from case hardened steel or other suitable material and which includes a generally rectangular slot 198 formed through the height dimension thereof. Formed in the rearward end surface 200 of the operating rod 156 are slots or channels 202 and 204 having a divider rib 206 disposed therebetween. The divider rib 206 includes outwardly extending flanges 208, the bottom edge surfaces of which are spaced apart from the bottom edges of the slots 202 and 204 by a distance corresponding to the spacing between the bottom edges 168 and the guide channels 166 of the receiver member 150. As such, the flanges 208 on the slide 156 are dimensioned so as to ride within the slots 166 with the bottom edge surfaces 168 abutting the bottom edge surfaces of the slots 202 and 204. Thus, both the bolt 152 and the operating rod or slide 156 may slide in a reciprocating fashion relative to the receiver member 150.

As has already been mentioned, there is also formed in each of the side walls 210 and 212 of the operating rod 156 parallelly disposed, transversely extending, arcuate slots 196 through which the locking roller 154 is adapted to pass. The slots are generally disposed at a predetermined angle with respect to the longitudinal axis of the operating rod such that the rearward end of the slot is at a higher elevation than is the forward end. These two ends are joined by arcuate segments which define a cam surface, all as will be more further described hereinbelow.

Now that the details of the construction of the piece parts comprising the alternative embodiment have been described in detail, consideration will next be given to the mode of operation thereof.

OPERATION—ALTERNATIVE EMBODIMENT

Figure 8:
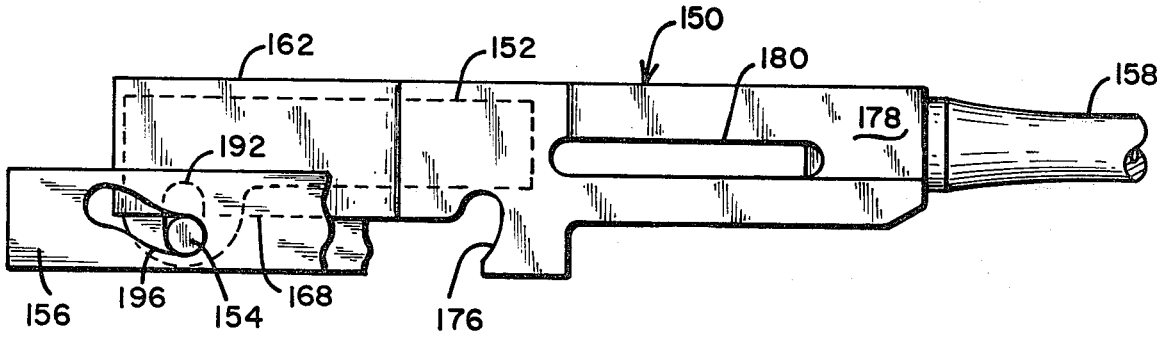
FIG. 8 is a right side elevation of the embodiment of FIG. 7 with the bolt and operating rod in their rearmost orientation.

By reference to FIG. 8, one can readily visualize the relative orientation of the several parts when the breech locking mechanism is in its unlocked condition. In FIG. 8, the bolt member 152 is shown in broken line form and a portion of the operating rod or slide 156 is broken away and removed to expose the cam surfaces 176 formed in the central portion of the receiver member 150. In the unlocked condition, the locking roller 154 is disposed in the bottom of the arcuate slots 196 and is prevented from rising therein by the bottom edge surfaces 168 on the rearwardly extending U-shaped channel portion 162 of the receiver member. As such, the locking pin 154 also is disposed in the bottom most position within the slot 192 formed through the lug 190 of the bolt 152.

A recoil spring (not shown) engages the end surface 200 of the operating rod and urges the operating rod in a forward direction. Thus, after the gas pressure from the previously fired cartridge has been relieved, the recoil spring takes over to move the operating rod in the forward direction, i.e., towards the barrel. In that the locking roller 154 engages both the side walls of the operating rod and the walls in the bolt defined by the slot 192, the bolt will also be carried forward as the operating rod travels to the right when viewed as in FIG. 8.

Figure 9:
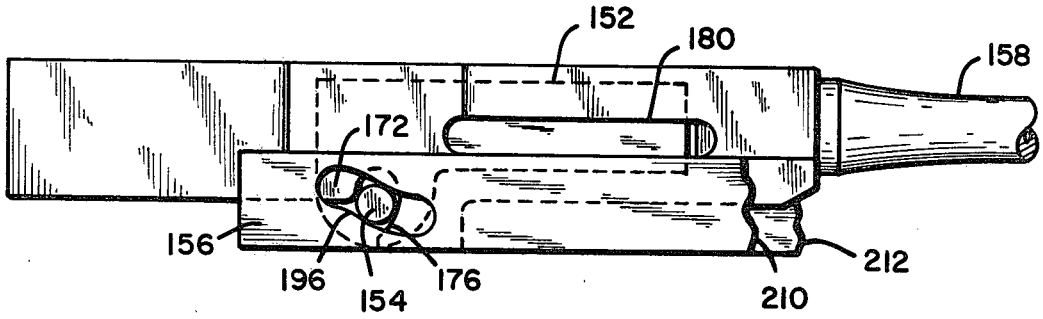
FIG. 9 is a right side elevation of the embodiment of FIG. 7 showing the locking roller beginning its ascent into a locking relationship between the bolt and receiver member.

Now, with reference to FIG. 9, there is shown the orientation of the parts when the slide and bolt have moved in a forward direction to the point where the locking roller 154 engages the cam surfaces 174 and 176 formed in the midsection portion 172 of the receiver member 150. In traveling to the right, the rib 194 formed on the underside of the bolt engages the uppermost cartridge contained in the clip and urges it up a ramp (not shown) so that the cartridge will be forced into the gun's chamber. As the locking roller 154 engages the cam surfaces 174 and 176 on the receiver, it will be urged upwardly by the camming action afforded by the walls of the arcuate slot 196 as shown in FIG. 9.

Figure 10:
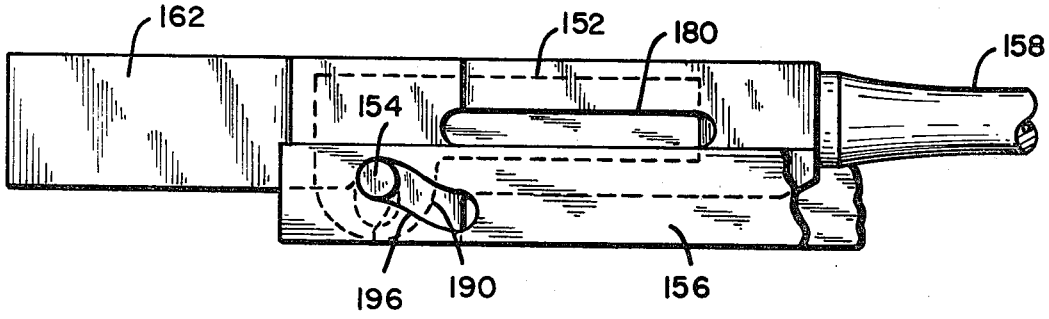
FIG. 10 is a right side elevation of the embodiment of FIG. 7 showing the orientation of the parts when the bolt is in its locked or firing position.

Following the initial engagement of the locking roller 154 by the camming surfaces 174 and 176, the bolt and operating rod continue to move forward until the locking roller 154 is fully elevated within the arcuate slot 196. This is the orientation of the parts as illustrated in FIG. 10. This is the orientation when the parts are in their fully locked condition prior to firing. It can be seen that when the locking roller 154 is in its fully elevated position, its side surfaces engage the curved upper portion of the slots 174 and 176 and is held in this disposition by the engagement between the locking roller 154 and the bottom edge surfaces of the arcuate slots 196. Thus, both the bolt 152 and the operating rod 156 are locked with respect to the receiver member 150.

When the gun is fired, the gases developed in the barrel are fed through a piston/cylinder combination (not shown) which coacts with the operating rod or slide 156 to move it in a rearward direction. As the operating rod moves rearward, the upper side surface of the locking roller 154 engages the upper edge of the arcuate slot 196 formed in the operating rod such that the locking roller 154 is forced downward relative to its locked position in the recesses of the receiver member and within the slot 192 formed in the lug 190 of the bolt 152. Because of the angle of incline provided in the arcuate slot 196, the locking pin 154 does not suddenly become disengaged from the receiver member, but instead, the bolt is allowed to move rearward at a substantially lower rate of speed than the speed at which the operating rod itself is traveling. As such, the initial rearward movement of the bolt is slow which, again, serves to relieve the stress on the extractor fingers and also prevents tearing of the rim on the shell casing which would otherwise lead to jamming. With reference to FIG. 9, the locking roller 154 is shown in the partially unlocked position following the initial rearward movement of the operating rod following firing.

Once the locking roller 154 is allowed to fall to its lowermost orientation, it no longer engages the semicircular upper portion of the cam surfaces 174 and 176 of the receiver member and the operating rod and bolt move rearward at the same, relatively high, speed. The spent shell is then ejected out from the slot 180 and the firing cycle can then be repeated.

It is to be further noted that until the locking roller 154 reaches its fully locked orientation as illustrated in FIG. 10, the rearward end of the bolt 152 remains separated by a predetermined distance from the forward edge of the pedestal 206 formed at the rearward end of the operating rod 156. Because of this spacing, the firing pin (not shown) cannot engage the primer of the cartridge until the bolt, operating rod and receiver member are fully locked. This precludes premature firing prior to breech closure.

Thus, the present invention provides a very simple breech locking mechanism which ensures that the shell is properly locked within the chamber at the moment of firing. Also, the locking elements which are subject to the high pressure loads at the moment of firing are designed to fully withstand the pressures and thus relieve the force from those components which are relatively less rugged and able to withstand the rather tremendous impulses to which the mechanism is exposed during firing. This results in substantial simplifications and considerably increases the life of the firearm.

While there has been shown and described a preferred embodiment of the invention and an alternative embodiment of the invention, it will be apparent to those skilled in the art who read this specification that various changes and modifications can be made which properly fall within the scope of the invention. Hence, the true spirit and scope of the invention are to be determined from the following claims.

What is claimed is:

1. A breech lock mechanism for a firearm comprising:

(a) a receiver member having a first longitudinally extending guide track formed in a bottom surface thereof, first and second longitudinally extending guide slots formed in parallel and spaced apart side surfaces thereof and a barrel receiving bore formed in an end surface thereof and generally aligned with said first and second guide slots, there being first and second locking pin receiving slots formed in said side surfaces below and at a predetermined angle with respect to said guide slots;

(b) an elongated operating rod disposed in said longitudinally extending guide track in said receiver member for reciprocating motion therein;

(c) a bolt carrier coupled to said operating rod and having first and second, parallel and spaced apart fingers adapted to pass along said first and second guide slots in said receiver member as said operating rod is moved;

(d) a bolt member disposed between said first and second fingers of said bolt carrier and coupled to said operating rod for movement therewith; and (e) a locking pin extending transversely to said longitudinally extending guide track and passing through said first and second locking pin receiving slots in said receiver member.

2. Apparatus as in claim 1 wherein said operating rod includes a transversely extending cam surface at a predetermined point along its length for engaging and lifting said locking pin within said locking pin receiving slots so as to lock said bolt member with respect to said receiver member when said operating rod is in its extreme forward position in said guide track.

3. Apparatus as in claim 2 wherein said fingers of said bolt carrier each include a cam surface for engaging and lowering said locking pin within said locking pin receiving slots so as to release said bolt member with respect to said receiver member when said operating rod is moved rearward from its said extreme forward position.

4. Apparatus as in claim 3 wherein said predetermined angle of said locking pin receiving slots causes said bolt member to initially move rearward at a lower rate than said operating rod as said operating rod is moved from its extreme forward position to its extreme rearward position within said guide track.

5. Apparatus as in claim 1 wherein said bolt member further includes:

(a) a detent finger pivotally secured thereto at one side thereof proximate said first guide slot.

6. Apparatus as in claim 5 and further including a recess formed in said first guide slot and a cam surface formed on one of said fingers of said bolt carrier and located such that when said operating rod is moved to its extreme forward position, said cam surface on said finger urges said detent finger into said recess for allowing said bolt carrier to closely abut said bolt member so long as said operating rod remains in said extreme forward position.

7. A breech lock mechanism for a firearm comprising:

(a) a receiver member;

(b) a bolt member mounted for reciprocating motion within said receiver member;

(c) a locking roller disposed in said receiver member oriented transverse to the direction of said reciprocating motion for locking said bolt with respect to said receiver member when said bolt is moved to a predetermined location within said receiver member;

(d) an operating rod including first and second parallel, spaced apart side walls having guide means formed therein, said guide means cooperating with said receiver member for constraining the relative motion between said operating rod and said receiver member to reciprocating straight line motion; and (e) first and second aligned camming slots formed through said first and second side walls and extending generally at an angle with respect to the longitudinal axis of said operating rod for receiving the opposed ends of said locking roller extending beyond said receiver member.

* * * * *